US012654058B1

(12) United States Patent
Chernicoff et al.

(10) Patent No.: US 12,654,058 B1
(45) Date of Patent: Jun. 16, 2026

(54) EXERCISE FOR USERS WITH LIMB DIFFERENCES

(71) Applicant: Toyota Mobility Foundation, Plano, TX (US)

(72) Inventors: William Chernicoff, Silver Spring, MD (US); Christopher Eugene Cloud, Glenn Heights, TX (US); Benjamin C. Johnston-Leamon, Allen, TX (US); Seth D. Orsborn, McKinney, TX (US)

(73) Assignee: Toyota Mobility Foundation, Plano, TX (US)

( * ) Notice: Subject to any disclaimer, the term of this patent is extended or adjusted under 35 U.S.C. 154(b) by 0 days.

(21) Appl. No.: 19/259,251

(22) Filed: Jul. 3, 2025

(51) Int. Cl.
*A63B 21/00* (2006.01)

(52) U.S. Cl.
CPC ..... *A63B 21/4011* (2015.10); *A63B 2220/51* (2013.01); *A63B 2225/74* (2020.08)

(58) Field of Classification Search
CPC . A63B 21/065; A63B 21/055; A63B 21/0555; A63B 21/0557; A63B 21/0552; A63B 21/00043; A63B 21/4011; A63B 2220/51; A63B 2225/74; A61F 5/3715; A61F 5/0102; A61F 5/0111; A61F 5/0585; A61F 13/064; A61G 13/123
See application file for complete search history.

(56) References Cited

U.S. PATENT DOCUMENTS 4,480,830 A 11/1984 Petrofsky et al.
5,052,379 A 10/1991 Airy et al.
5,626,544 A * 5/1997 Foresto ..... A63B 21/4017 482/93
6,149,559 A 11/2000 Mackey
8,025,632 B2 9/2011 Einarsson
8,657,772 B2 2/2014 Einarsson
8,708,873 B2 4/2014 Birsch et al.
10,857,425 B2 * 12/2020 Thomas ..... A63B 21/4043
11,311,767 B1 4/2022 Boyd
11,737,926 B2 * 8/2023 Astilla ..... A61F 13/062 128/888
12,036,024 B2 * 7/2024 Popov ..... A63B 21/0552
(Continued)

FOREIGN PATENT DOCUMENTS

KR 20240002357 A 1/2024
WO 2016054623 A1 4/2016
(Continued)

OTHER PUBLICATIONS

Wikipedia, "Resistance Band", retrieved from the Internet: <https://en.wikipedia.org/wiki/Resistance_band>, retrieved Jun. 3, 2025 (2 pages).

*Primary Examiner* — Loan B Jimenez
*Assistant Examiner* — Jonathan A Dicuia
(74) *Attorney, Agent, or Firm* — Christopher G. Darrow; Darrow Mustafa PC

(57) ABSTRACT

A brace can be used to make it easier for people with lower limb differences to engage in an active lifestyle. The brace can have a body that is sized to wrap around a portion of a human limb (e.g., a residual limb). The body can have an undulating shape. When the brace is wrapped around a human limb, lateral end regions of the body can overlap and can be connected to each other. In this configuration, the brace can have a substantially conical shape. The brace can be a part of a system and/or a kit.

20 Claims, 9 Drawing Sheets

(56) References Cited

U.S. PATENT DOCUMENTS

| | | | | |
|---|---|---|---|---|
| 2007/0202992 | A1 | 8/2007 | Grasshoff | |
| 2017/0282013 | A1 | 10/2017 | Paulsen | |
| 2018/0064991 | A1 | 3/2018 | Yanev et al. | |
| 2019/0041282 | A1 | 2/2019 | Chen | |
| 2019/0111298 | A1* | 4/2019 | Whalen | A61H 9/0092 |
| 2019/0126097 | A1* | 5/2019 | Thomson | A63F 13/816 |
| 2020/0222740 | A1 | 7/2020 | Alexander et al. | |
| 2022/0409943 | A1 | 12/2022 | Lee et al. | |
| 2023/0110715 | A1 | 4/2023 | David et al. | |
| 2024/0123274 | A1* | 4/2024 | Coen | A63B 21/4035 |

FOREIGN PATENT DOCUMENTS

| | | | | |
|---|---|---|---|---|
| WO | WO-2021252474 | A1 * | 12/2021 | A63B 21/0557 |
| WO | 2023133326 | A2 | 7/2023 | |

* cited by examiner

EXERCISE FOR USERS WITH LIMB DIFFERENCES

FIELD

The subject matter described herein relates in general to exercise and, more particularly, to exercise for people with limb differences.

BACKGROUND

There are numerous types of equipment that can be used to support various exercise objectives. For example, resistance bands can be used for strength training. Resistance bands can be used in connection with physical therapy to build strength of a person. Resistance bands can be provided in different colors to reflect different levels of resistance.

SUMMARY

In one respect, the present disclosure is directed to a brace. The brace can include a body sized to wrap around a portion of a human limb. The body can have an undulating shape. The brace can include a first connector provided in a first lateral end region of the body and a second connector provided in a second lateral end region of the body. The body can have an open configuration and a closed configuration. When the first and second connectors are connected to each other, the brace can be held in the closed configuration in which the brace has a substantially conical shape.

In another respect, the present disclosure is directed to a system. The system includes a brace. The brace can include a body sized to wrap around a portion of a human limb. The body can have an undulating shape. The brace can include a first connector provided in a first lateral end region of the body and a second connector provided in a second lateral end region of the body. The first and second connectors can be connected to hold the brace in the closed configuration where the brace has a substantially conical shape. The system can include a control unit. The system can include a resistance member that has a first end operatively connected to the brace and a second end operatively connected to the control unit. The control unit can be configured to measure a force exerted on the resistance member by a user.

In still another respect, the present disclosure is directed to a kit. The kit can include a brace, a resistance member, and a control unit. The brace can include a body sized to wrap around a portion of a human limb. The body can have an undulating shape. The brace can include a first and second connector provided at opposite lateral end regions of the body. The first and second connectors can be connectable to hold the brace in a closed configuration in which the brace has a substantially conical shape. The resistance member can have a first end configured for operative connection to the brace and a second end configured for operative connection to the control unit. The control unit can include a generator for generating electrical energy to power the control unit. The control unit does not have a battery. The control unit can be configured to cause a resistance to be applied to the resistance member.

DETAILED DESCRIPTION

Figure 1:
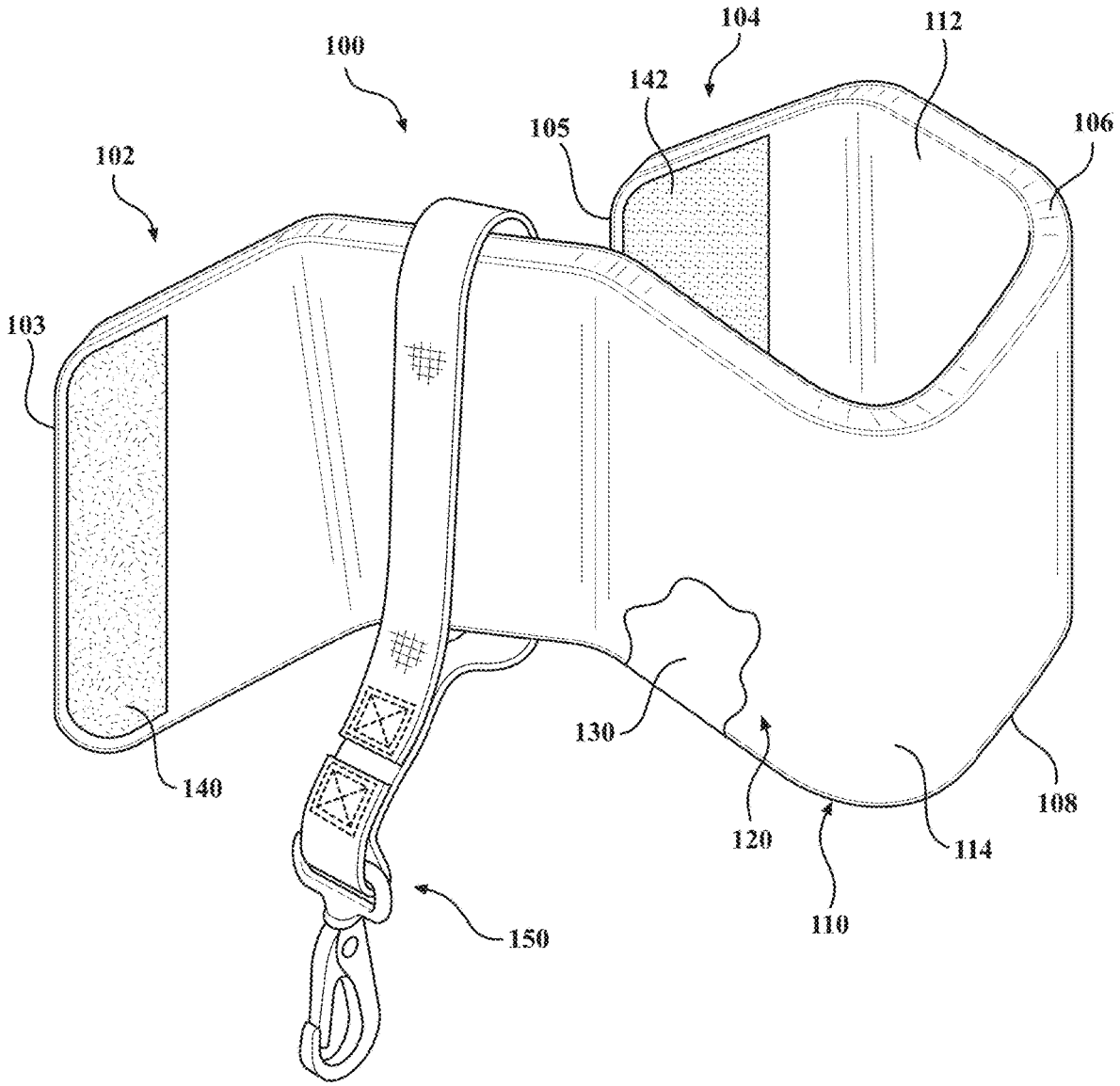
FIG. 1 is an example of a brace for a residual limb, showing an open configuration.

There are many types of exercise and rehabilitation equipment available to users. However, the commercially available products are often not compatible, suitable, and/or present safety risks for users with limb differences. As used herein, "limb differences" means any human limb (e.g., arm or leg) which is partially missing, not fully formed, or formed differently. A person may be born with a limb difference, or the limb difference may be due to the loss of a limb (e.g., an amputee). The limb with the difference may be referred to herein as a residual limb. Commercially available exercise and rehabilitation equipment may not properly fit a residual limb properly or may slip off of the residual limb during exercise.

Accordingly, arrangements described herein are directed to making it easier and/or safer for people with lower limb differences to engage in an active lifestyle. Arrangements described herein are directed to a brace. The brace can have a body that is sized to wrap around a portion of a human limb (e.g., a residual limb). The body can have an undulating shape. When the brace is wrapped around a human limb, end regions of the body can be connected to each other. In this configuration, the brace can have a substantially conical shape. The substantially conical shape can provide various benefits when used by a person with a limb difference, as described herein. The brace can be a part of a system and/or a kit.

Detailed embodiments are disclosed herein; however, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-9, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

Figure 2:
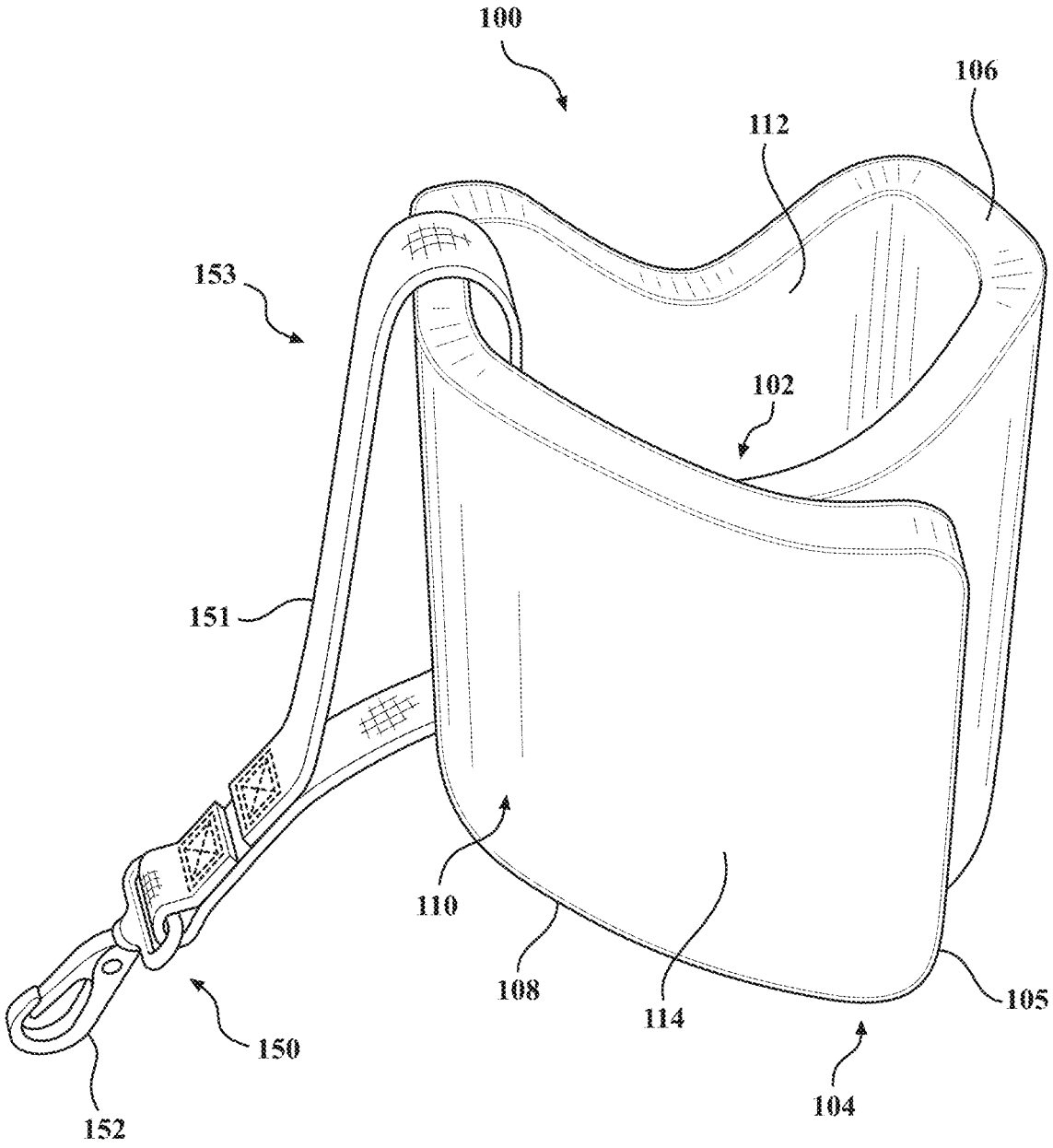
FIG. 2 is an example of the brace of FIG. 1, showing a closed configuration.
Figure 9:
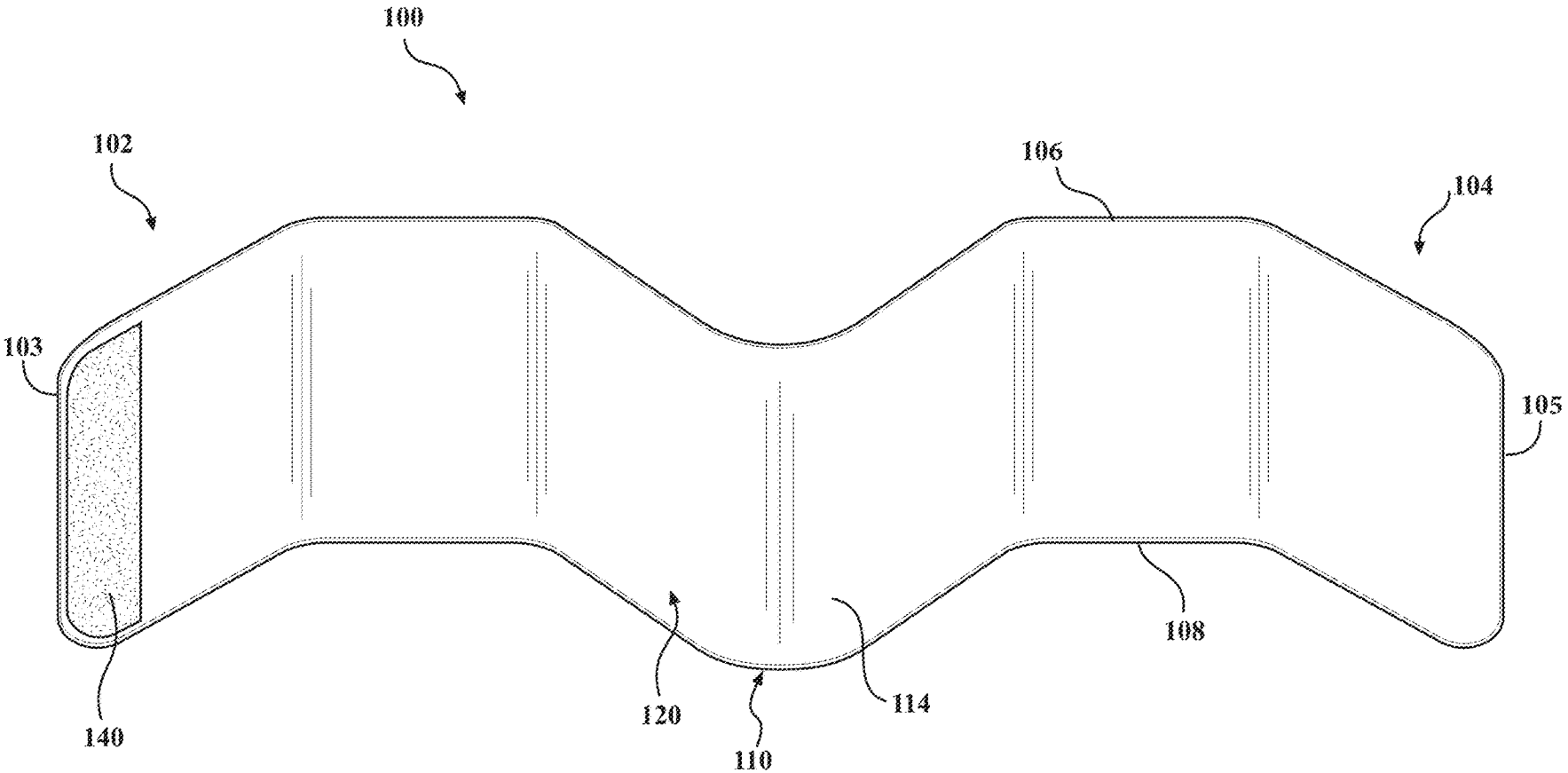
FIG. 9 is an example of the brace of FIG. 1, showing an open configuration in which the body is substantially flat.

Referring to FIGS. 1-2 and 9, an example of a brace 100 according to arrangements herein is shown. FIG. 1 shows an example of the brace 100 in an open configuration, and FIG. 2 shows an example of the brace 100 in a closed configuration. FIG. 9 shows an example of the brace 100 in another open configuration.

The brace 100 can have a first lateral end region 102 including a first lateral end 103. The brace 100 can have a second lateral end region 104 including a second lateral end 105. The first lateral end region 102 and the second lateral end region 104 can be opposing lateral end regions. The brace 100 can have a first side 106 and a second side 108. The brace 100 can have an inner face 112 and an outer face 114. The terms "inner" and "outer" in this context refer to the relative position of the respective face to a portion of a human body to which the brace 100 is attached.

The brace 100 can have any suitable size, shape, and/or configuration. The brace 100 can be configured to wrap about a portion of a human limb and, more particularly, a portion of a human residual limb (upper arm, forearm, leg above the knee, leg below the knee, or ankle). In some arrangements, the brace 100 can be configured to wrap around any portion of an upper limb or a lower limb of a user.

In some arrangements, the brace 100 can be sized based on an average limb size for a particular sex and/or for a particular age category (e.g., adult, child, etc.). In some arrangements, the brace 100 can be sized based on a percentile or range of percentiles for a particular sex and/or for a particular age category (e.g., adult, child, etc.). As an example, the brace 100 can be sized to fit users of a particular sex and/or for a particular age category from about the 1% to about the 99% percentile and any combination of lower and upper percentiles in between (e.g., from about the 5% to about the 95% percentile, from about the 10% to 90% percentile, from about the 15% to the 85% percentile, from about the 20% to about the 80% percentile, from about the 25% to the 75% percentile, from about the 30% to about the 70% percentile, etc.). In some arrangements, the brace 100 can be configured to fits all users (e.g., one size fits all).

The brace 100 can have a body 110. In some arrangements, the body 110 can be a single piece of material. In other arrangements, the body 110 can be made of a plurality of materials and/or a plurality of pieces. For example, the body 110 can include an outer cover 120 and a liner 130. In one or more arrangements, the outer cover 120 can be made of a plastic material or any other material suitable for contact with a human body. The outer cover 120 can be made of a soft material. In some arrangements, the outer cover 120 can be made of nylon. The material of the outer cover 120 or one or more coatings provided on the outer cover 120 can provide desired properties, such as anti-slip and/or anti-microbial properties.

The liner 130 can be made of any suitable material. In one or more arrangements, the liner 130 can be made of foam. As an example, the liner 130 can be made of ethylene vinyl acetate (EVA) foam. The liner 130 can be soft, compliant, and/or moldable.

The brace 100 can have an undulating shape. For instance, in the example shown in FIGS. 1-2 and 9, the brace 100 can be substantially m-shaped or substantially w-shaped. In one or more arrangements, the brace 100 can have a multi-v shape or a multi-u shape. That is, the brace 100 can be made of a plurality of substantially v-shaped portions or a plurality of substantially u-shaped portions. In the example shown in FIGS. 1-2 and 9, there can be two substantially v-shaped portions or substantially u-shaped portions. However, it will be appreciated that there can be more than two substantially v-shaped portions or substantially u-shaped portions. When there is a plurality of v-shaped portions (or u-shaped portions), the plurality of v-shaped portions (or u-shaped portions) can be substantially identical to each other, or one or more of the portions can be different from the other portions. Other examples of an undulating shape include wave, sinusoidal, square wave, and saw tooth shapes.

In the open configuration, the brace 100 can be substantially flat (see, e.g., FIG. 9). Alternatively, in the open configuration, the brace 100 can have some curvature or other non-flat configuration (see, e.g., FIG. 1). In the closed configuration, the brace 100 can have a substantially conical shape, as shown in FIG. 2. "Substantially conical shape" includes conical, substantially conical, substantially frusto-conical shape, substantially truncated conical, and partial conical shapes. The first side 106 can form a larger diameter than the second side 108 when the brace 100 is in the closed configuration. The substantially conical shape of the brace 100 allows the brace 100 to conform to the residual limb of a user. Thus, the brace 100 can conform to residual limbs of various sizes, thereby avoiding the need for a customized brace.

Further, users with limb differences do not have portions of the limb (e.g., knee, foot, hand, etc.) that would normally stop the brace 100 for sliding off the limb. The substantially conical shape of the brace 100 can help in this regard. For instance, the substantially conical shape of the brace 100 can help to maximize frictional contact with the residual limb of a user, thereby preventing slippage and sliding off of the brace 100. The maximized contact can allow a user to put more shear force onto the brace 100 during use. Thus, the substantially conical shape of the brace 100 in the closed configuration can provide various benefits.

The brace 100 can be configured to be attached onto itself. For instance, the first lateral end region 102 and the second lateral end region 104 can be configured to attach to each other. To that end, the first lateral end region 102 and the second lateral end region 104 can be configured with any suitable fastener, now known or later developed, to enable their connection. In one or more arrangements, the first lateral end region 102 and the second lateral end region 104 can include corresponding hook and loop (e.g., VELCRO®) type fasteners. In one or more arrangements, the first lateral end region 102 and the second lateral end region 104 can include snaps, connectors, belts, straps, or any other suitable fastener. In one or more arrangements, a first connector 140 can be provided in the first lateral end region 102, and a second connector 142 can be provided in the second lateral end region 104.

In some arrangements, the first and second lateral end regions 102, 104 can at least partially overlap each other when the brace 100 is in the closed configuration. In other arrangements, the first and second lateral ends 103, 105 can abut each other or can be adjacent to each other when the brace 100 is in the closed configuration. The first connector 140 and the second connector 142 can be located proximate each other when the brace 100 is in the closed configuration such that the first connector 140 and the second connector 142 are connectable. When the first connector 140 and the second connector 142 are connected, the brace 100 can be held in the closed configuration.

When the brace 100 is in an open configuration, the first connector 140 and the second connector 142 can be spaced from each other. As a result, the first connector 140 and the second connector 142 are not connected to each other.

The brace 100 can be configured for connection to a resistance member. To that end, the brace 100 can include one or more connectors 150 configured to operatively connect to a resistance member. In one or more arrangements, the connector(s) 150 can be ring(s), D-ring(s), carabiner(s), anchor(s), clip(s), strap(s), hook(s), any other type of mechanical connector, or any combination thereof. In some arrangements, the connector(s) 150 can be permanently attached to the brace 100 so that the connector(s) 150. "Permanently attached" means that the connector(s) 150 cannot be removed from the brace 100 without destroying or damaging the brace 100 and/or the connector(s) 150. In some arrangements, the connector(s) 150 can be removable from the brace 100. As an example, the connector(s) 150 can include a strap 151 and a clip 152. The strap 151 can form a loop 153. The loop 153 can be placed about the body 110 of the brace 100 when in the open configuration. Thus, a portion of the body 110 can be received within the loop 153.

Figure 3:
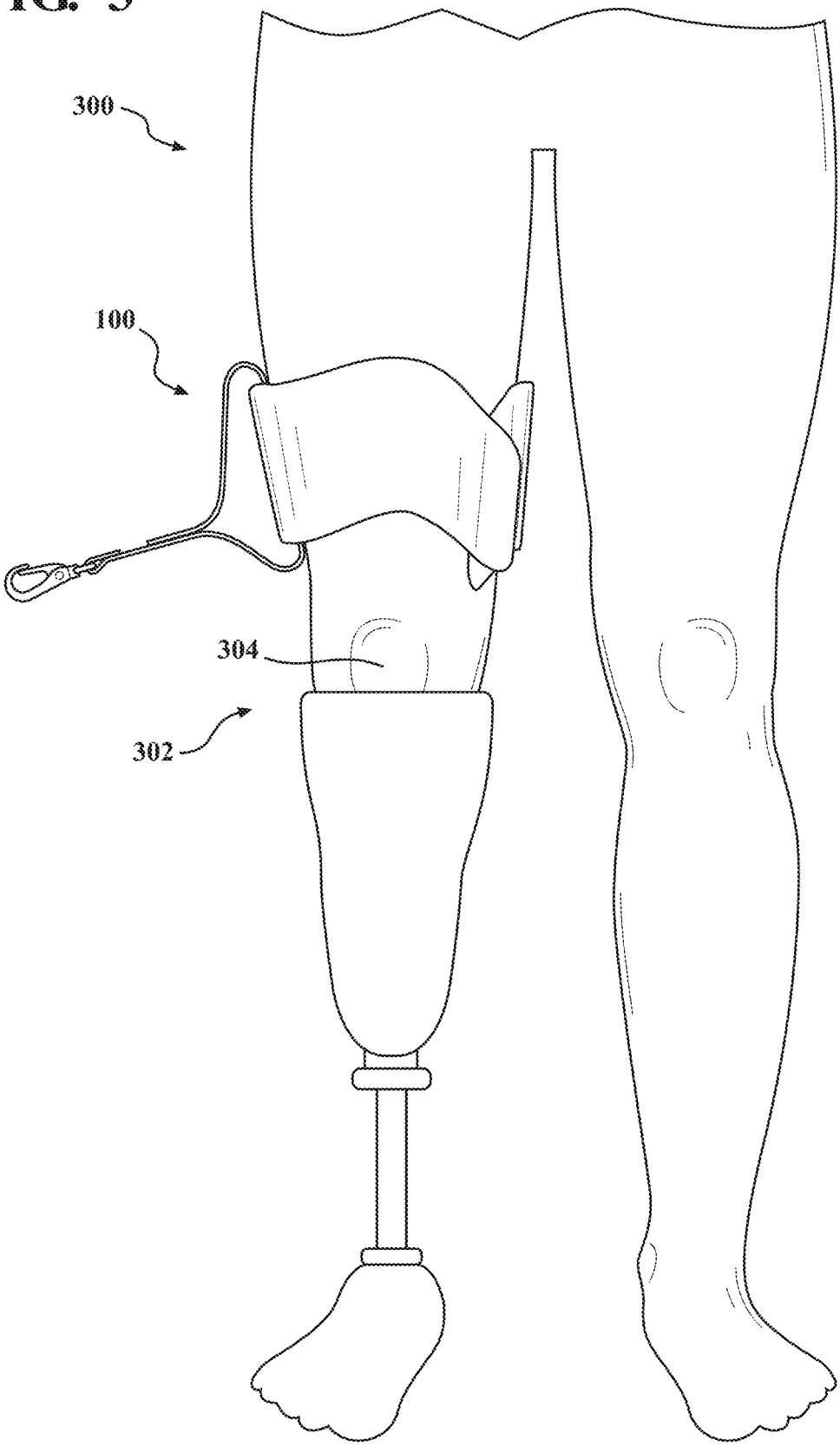
FIG. 3 is an example of the brace of FIG. 1 used by a person with a lower limb difference, showing the brace used above the knee.
Figure 4:
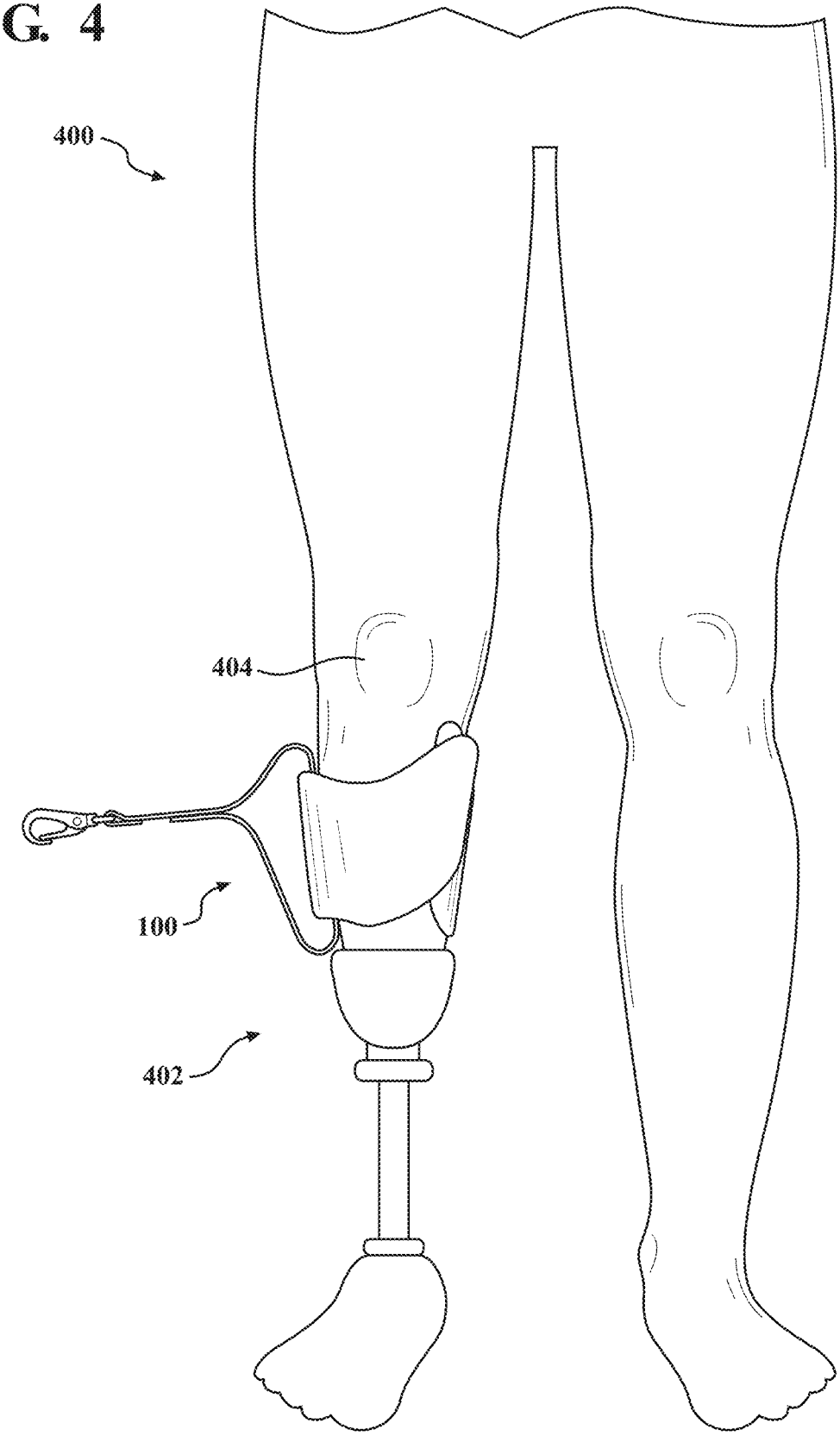
FIG. 4 is an example of the brace of FIG. 1 used by a person with a lower limb difference, showing the brace used below the knee.
Figure 5:
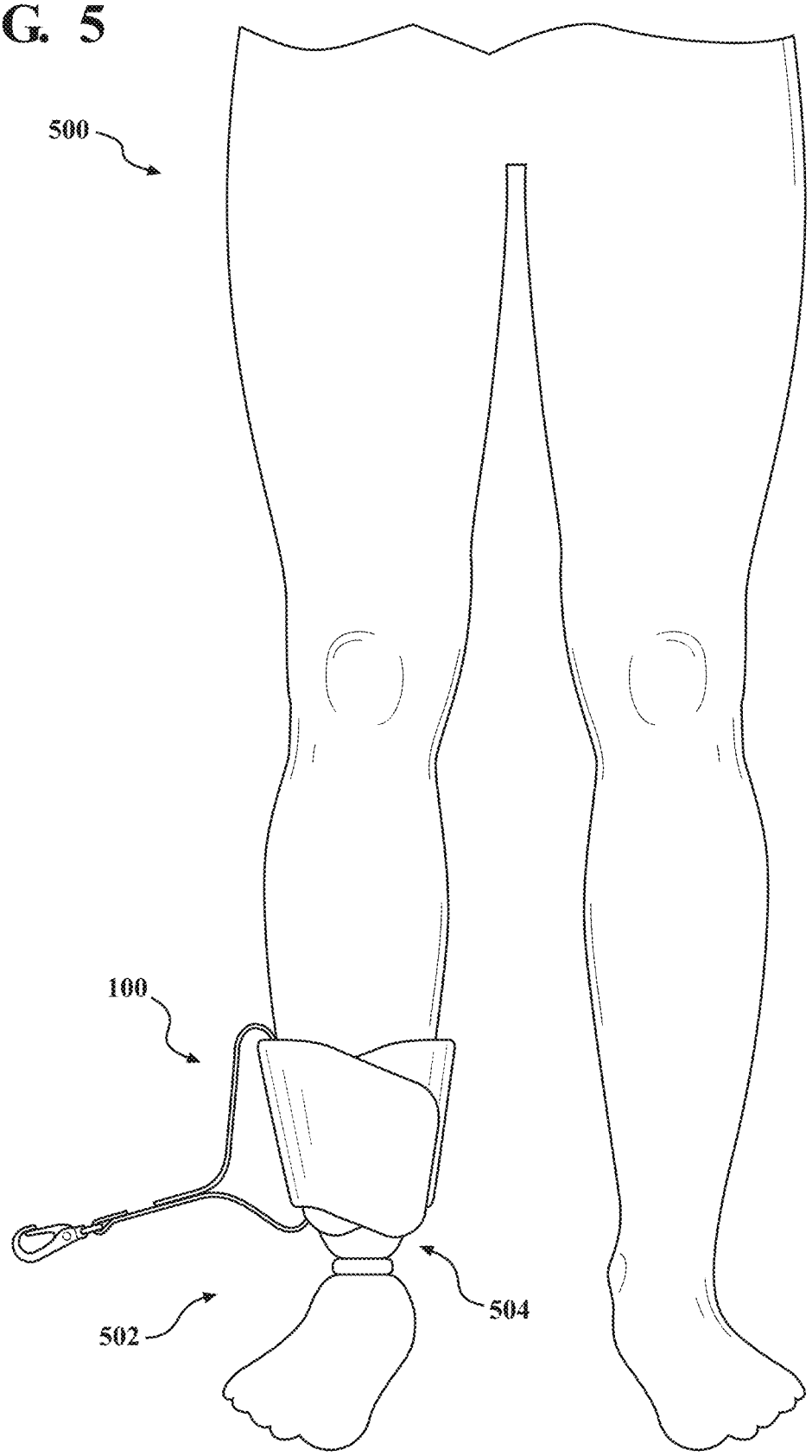
FIG. 5 is an example of the brace of FIG. 1 used by a person with a lower limb difference, showing the brace used at or above the ankle.

The brace can be arranged in different orientations depending on the usage. FIG. 3-5 show some examples of such different orientations.

Referring to FIG. 3, an example of the brace 100 being used by a person 300 with a lower limb difference is shown. In this example, the person 300 has a lower limb difference in that the residual limb 302 terminates at or just below the knee 304. Here, the brace 100 can be used above the knee 304 of the residual limb 302. In this case, the brace 100 can be in the first orientation. In such orientation, the first side 106 of the brace 100 can be located above the second side 108 in the elevational direction (i.e., the up-down direction in FIG. 3). Further, in the closed configuration, a smaller diameter end of the substantially conical shape can be located below the larger diameter end of the body 110 in the elevational direction. It will be appreciated that such an orientation of the brace 100 can reduce slipping.

Further, it will be appreciated that the brace 100 can be oriented so that it "points" pressure away from the knee 304 or kneecap. Thus, the "peaks" of the undulating shape of the first side 106 of the brace 100 do not line up with the knee 304 or kneecap. Rather, the "peaks" are offset from the knee 304 or kneecap by substantially 90 degrees in FIG. 3. The "peaks" are located on the inner thigh and/or the outer thigh of the person. As a result, a "valley" of the undulating shape of the first side 106 of the brace 100 lines up with the knee 304 or kneecap. Forces exerted by the brace 100 on the user are distributed away from the knee 304 or kneecap, thereby avoiding placing any undue pressure thereon.

FIG. 4 shows another example of the brace 100 being used by a person 400 with a lower limb difference is shown. In this example, the person 400 has a lower limb difference in that the residual limb 402 terminates below the knee 404. Here, the brace 100 can be used on the residual limb below the knee 404. In this case, the brace 100 can be in the second orientation. In such orientation, the first side 106 of the brace 100 can be located below the second side 108 in the elevational direction (i.e., the up-down direction in FIG. 4). Further, in the closed configuration, the smaller diameter end of the cone can be located above the larger diameter end of the body 110 in the elevational direction. It will be appreciated that such an orientation of the brace 100 can reduce slipping. It will also be appreciated that, in the second orientation, the brace 100 can "point" pressure away from the knee 304 or kneecap, similar to as is described above in connection with FIG. 3.

Turning to FIG. 5, an example of the brace 100 being used by a person 500 with a lower limb difference is shown. In this example, the person 500 has a lower limb difference in that the residual limb 502 terminates at or near the ankle 504. Here, the brace 100 can be used at the ankle 504 of the residual limb 502. In this case, the brace 100 can be in the first orientation. In such orientation, the brace 100 the first side 106 of the brace 100 can be located above the second side 108 in the elevational direction. Further, in the closed configuration, the smaller diameter end of the cone can be located below the larger diameter end of the body 110 in the elevational direction. It will be appreciated that such an orientation of the brace 100 can reduce slipping. In this example, the "peaks" and "valleys" of the undulating shape of the brace 100 are remote from the knee or kneecap, thereby reducing pressure pointing concerns. As a result, the "peaks" and "valleys" can be oriented in any suitable manner.

Figure 6:
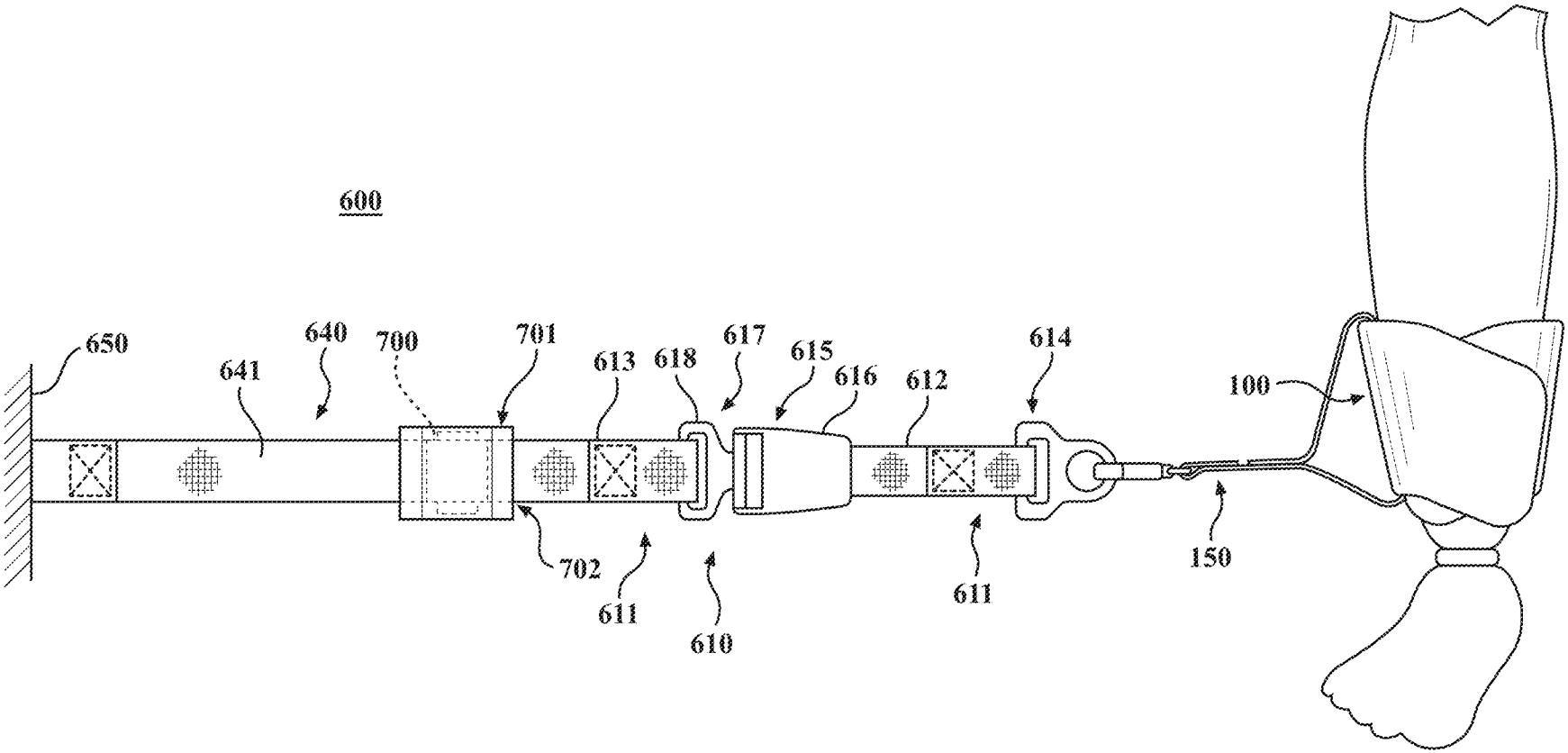
FIG. 6 is an example of an exercise system for a person with a limb difference.

Referring to FIG. 6, the brace 100 can be part of a system 600. The system 600 can include various elements. Some of the possible elements of the system 600 are shown in FIG. 6 and will now be described. It will be understood that it is not necessary for the system 600 to have all of the elements shown in FIG. 6 or described herein. The system 600 can have any combination of the various elements shown in FIG. 6. Further, the system 600 can have additional elements to those shown in FIG. 6. In some arrangements, the system 600 may not include one or more of the elements shown in FIG. 6. Further, the elements shown may be physically separated by large distances.

The system 600 can include the brace 100, a resistance member 610, a control unit 700, and a connecting member 640. These elements will be described in turn below.

The resistance member 610 can be any type of member that a person can pull on. The resistance member 610 can be a cable, strap, band, belt, webbing, or any combination thereof. In some arrangements, the resistance member 610 can be a single member. In other arrangements, the resistance member 610 can be made of a plurality of segments. In such case, the plurality of segments can be selectively coupled and decoupled from each other.

In one or more arrangements, the resistance member 610 can be a seat belt member 611. The seat belt member 611 can include a first segment 612 and a second segment 613. The first segment 612 can include a first connector 614 configured to connect to the brace 100. The first segment 612 can include a second connector 615 configured to connect to the second segment 613. In one or more arrangements, the second connector 615 can be a seat belt buckle 616 or a seat belt buckle tongue.

The second segment 613 can have a first end configured to connect to the first segment 612 by a connector 617. In one or more arrangements, the connector 617 can be a buckle tongue 618 or a buckle, the opposite of the second connector 615 and for engaging the second connector 615. The second end can be configured to connect to the control unit 700. To that end, the second end and/or the control unit 700 can include any suitable anchors or connectors.

The resistance member 610 can be rigid. For instance, the resistance member 610 can be a seat belt strap. When pulled on by a human being, a rigid resistance member does not stretch or exhibits minimal stretch such that its length increases no more than 5%, 4%, 3%, 2%, 1%, 0.9%, 0.8%, 0.7%, 0.6%, 0.5%, 0.4%, 0.3%, 0.2%, or 0.1% of its non-stretched length. In some arrangements, the resistance member 610 can be a flexible. As an example, the resistance member 610 can be a resistance band. When pulled on by a human being, a flexible resistance member can stretch so that its length increases by 10% or greater, 20% or greater, 30% or greater, 40% or greater, 50% or greater, 60% or greater, 70% or greater, 80% or greater, 90% or greater, 100% or greater, 150% or greater, 200% or greater, 250% or greater, or 300% or greater from its non-stretched length.

The control unit 700 can be configured to provide resistance on the resistance member 610 and/or to provide feedback to a user. More details of the control unit 700 will be described in connection with FIG. 7.

It will be appreciated that the control unit 700 can be configured such that, if the resistance member 610 or the connecting member 640 fails, there is no potential energy within the control unit 700 that is transferred to the user. In this way, injury to a user in such circumstances can be prevented.

The control unit 700 can be located within a housing 701. The housing can be made of any suitable material. The housing 701 can include an outer cover and a liner. The liner can be configured to protect the control unit 700. In one or more arrangements, the liner can be made of a foam material. The resistance member 610 can be operatively connected to the control unit 700 within the housing 701. The resistance member 610 can extend from the control until 700 and through an aperture 702 in the housing 701.

The system 600 can include a connecting member 640. The connecting member 640 can be operatively connected on one end to the housing 701 and/or to the control unit 700. The connecting member can extend from there to a fixed structure 650. The fixed structure 650 can be any suitable structure to which the connecting member 640 can be attached. In one or more arrangement, the fixed structure can be a door, a doorknob, a support column, a hook, a piece of furniture (e.g., a table, a couch, a bedframe, etc.), a wall, or other suitable object or structure, including common environmental objects.

The connecting member 640 can be a cable, strap, band, belt, or any combination thereof. In some arrangements, the connecting member 640 can be a single continuous structure. In other arrangements, the connecting member 640 can be made of a plurality of members. In such case, the plurality of members can be selectively coupled and decoupled from each other. In one or more arrangements, the connecting member 640 can be a seat belt strap 641. In some arrangements, the connecting member 640 and the resistance member 610 can be made of the same material, or they can be made of different materials.

Figure 7:
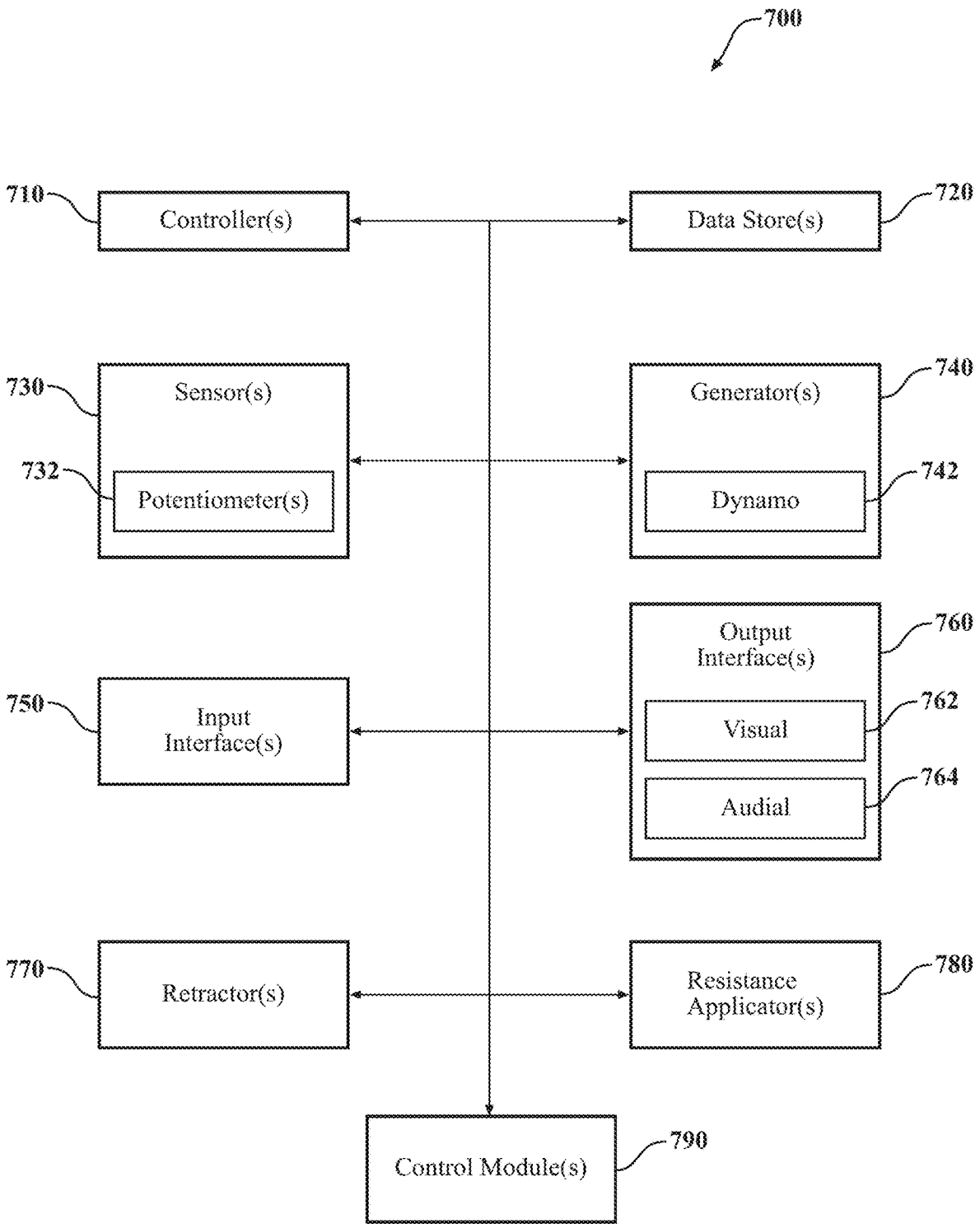
FIG. 7 is an example of a control unit.

The control unit 700 will now be described in greater detail in connection with FIG. 7. The control unit 700 can include various elements. Some of the possible elements of the control unit 700 are shown in FIG. 7 and will now be described. It will be understood that it is not necessary for the control unit 700 to have all of the elements shown in FIG. 7 or described herein. The control unit 700 can have any combination of the various elements shown in FIG. 7. Further, the control unit 700 can have additional elements to those shown in FIG. 7. In some arrangements, the control unit 700 may not include one or more of the elements shown in FIG. 7. Further, the elements shown may be physically separated by large distances.

Notably, in at least some arrangements, the control unit 700 does not have a battery or other power storage device. In such case, one or more elements of the control unit 700 can be powered according to arrangements described herein. However, in other arrangements, the control unit 700 may include one or more batteries, other power sources, and/or power storage devices.

As noted above, the control unit 700 can include one or more controllers 710. The controller(s) 710 can include any type of digital controllers, analog controllers, electronic controllers, or mechanical controllers, now known or later developed. Of course, the controller(s) 710 can be any combination of the above types of controllers.

In some arrangements, the controller(s) 710 can include one or more processors. "Processor" means any component or group of components that are configured to execute any of the processes described herein or any form of instructions to carry out such processes or cause such processes to be performed. The processor(s) may be implemented with one or more general-purpose and/or one or more special-purpose processors. Examples of suitable processors include microprocessors, microcontrollers, DSP processors, and other circuitry that can execute software. Further examples of suitable processors include, but are not limited to, a central processing unit (CPU), an array processor, a vector processor, a digital signal processor (DSP), a field-programmable gate array (FPGA), a programmable logic array (PLA), an application specific integrated circuit (ASIC), programmable logic circuitry, and a controller. The processor(s) can include at least one hardware circuit (e.g., an integrated circuit) configured to carry out instructions contained in program code. In arrangements in which there is a plurality of processors, such processors can work independently from each other or one or more processors can work in combination with each other.

In some arrangements, the controller(s) 710 can include one or more mechanical computers or processors. Examples of mechanical processors can include magnetic relays, switches, levers, gears, etc. In some arrangements, the controller(s) 710 can include one or more non-electrical analog devices, one or more electrical analog devices, or analog computers.

The processor(s) can be programmable to enable a user, a manufacturer, or some other entity to set a resistance level for the resistance member and/or to define the resistance level for the resistance member. The processor(s) can be programmable to define a maximum exertion level, a minimum exertion level, and/or a target exertion range.

In some arrangements, the control unit 700 can include one or more data stores 720 for storing one or more types of data. The data store(s) 720 can include volatile and/or non-volatile memory. Examples of suitable data stores 720 include RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof. The data store(s) 720 can be a component of the controller(s) 710, or the data store(s) 720 can be operatively connected to the controller(s) 710 for use thereby. The term "operatively connected," "operative connection," or variants thereof, as used throughout this description, can include direct or indirect connections, including connections without direct physical contact.

The data store(s) 720 can store different settings for the resistance member, exercise programs, etc. In some arrangements, the data store(s) 720 can store force exertion thresholds, such as a minimum force, a maximum force, a target force range, etc.

The control unit 700 can include one or more sensors 730. "Sensor" means any device, component and/or system that can detect, determine, assess, monitor, measure, quantify, acquire, and/or sense something. The one or more sensors can detect, determine, assess, monitor, measure, quantify, acquire, and/or sense in real-time. As used herein, the term "real-time" means a level of processing responsiveness that a user or system senses as sufficiently immediate for a particular process or determination to be made, or that enables the processor to keep up with some external process.

In arrangements in which the control unit 700 includes a plurality of sensors 730, the sensors can work independently from each other. Alternatively, two or more of the sensors can work in combination with each other. In such case, the two or more sensors can form a sensor network. The sensor(s) 730 can be operatively connected to the controller(s) 710, the data store(s) 720, and/or other elements of the control unit 700 (including any of the elements shown in FIG. 7.

The sensor(s) 730 can include any suitable type of sensor. Various examples of different types of sensors will be described herein. However, it will be understood that the embodiments are not limited to the particular sensors described.

The sensor(s) 730 can be configured to measure a force exerted on the resistance member 610 by a user. In some arrangements, the sensor(s) 730 can include a potentiometer 732. In some arrangements, the potentiometer 732 can be operatively connected to the controller(s) 710. The potentiometer 732 can send signals to the controller(s) 710, which, in turn can be configured to cause one or more output interface(s) 760 to activate based on the signals from the potentiometer 732. In some arrangements, the sensor(s) 730 can include mechanical sensors or mechanical systems, such as bimetal springs or bimetal strips.

The control unit 700 can include a generator 740. The generator 740 can be configured to create electrical energy from movement. More particularly, the generator 740 can be configured to create electrical energy from movement of the resistance member 610. In one or more arrangements, the generator 740 can be a dynamo 742. As a user exercises his or her residual limb, the resistance member 610 can move in and out of the control unit 700. The energy generated by this motion can be converted by the dynamo 742 into electrical energy, which can be used to power one or more elements of the control unit 700. As a result, the control unit 700 does not need a battery or other self-contained power source nor does the control unit 700 need to be plugged into a power source (e.g., a wall outlet). In some arrangements, the dynamo 742 can be a bicycle dynamo, a spin dynamo, or a linear alternator. It will be appreciated that the generator 740 can be any type of generator, now known or later developed.

The control unit 700 can include one or more input interfaces 750. An "input interface" includes any device, component, system, element or arrangement or groups thereof that enable information/data to be entered into a machine. The input interface(s) 750 can receive an input from a person or other entity. Any suitable input interface 750 can be used, including, for example, a keypad, display, touch screen, multi-touch screen, button, joystick, mouse, trackball, microphone, gesture recognition (radar, lidar, camera, or ultrasound-based), and/or combinations thereof. In one or more arrangements, the input interface(s) 750 can include a mechanical user interface element (e.g., a button, knob, dial, switch, etc.) for enabling a user to set (e.g., initially set or subsequently adjust) one or more resistance levels for the resistance member 610 (e.g., minimum, maximum, target, and/or a range) and/or to identify a resistance level of the resistance member 610 (e.g., high/medium/low, or corresponding to resistance band color levels (red, green, blue). In one or more arrangements, the input interface(s) 750 can include a graphical user interface element to enable a user to set (e.g., initially set or subsequently adjust) a resistance level for the resistance member 610 and/or to identify a resistance level of the resistance member 610.

The control unit 700 can include one or more output interfaces 760. An "output interface" includes any device, component, system, element or arrangement or groups thereof that enable information/data to be presented to a user (e.g., a person) or other entity. The output interface(s) 760 can present information/data to a user or other entity. The output interface(s) 760 can include a visual device, an audial device, and/or a haptic device. Some components of the control unit 700 may serve as both a component of the input interface(s) 750 and a component of the output interface(s) 760.

In one or more arrangements, the output interface(s) 760 can be configured to provide an indicator or warning. The indicator or warning can be any suitable type of indicator or warning and in any suitable form. In one or more arrangements, the output interface(s) 760 can include one or more visual indicators. A "visual indicator" is any output that provides an alert or warning in a manner that is perceptible to the human sense of sight. The visual indicator can be presented by one or more visual devices 762. The visual device(s) 762 can include one or more displays or one or more lights. In one or more arrangements the light(s) can include one or more light emitting diodes (LEDs). However, it will be appreciated that the light(s) can be any type of light source, now known or later developed. The light(s) can generate or emit any type of light energy. In one or more arrangements, the visual device(s) 762 can be electric powered. The visual device(s) 762 can be arranged in any suitable manner. It will be appreciated that the visual device(s) 762 are not limited to digital and electronic devices. Indeed, the visual device(s) 762 can be mechanical devices. As an example, the visual device(s) 762 can be configured to reveal a color or other visual indicator by using a spring switch.

In some arrangements, the visual indicator can provide an indicator or warning based on the number of lights activated, the color of the light emitted from the light(s), and/or some other characteristic of the light emitted from the light(s). For instance, as the amount of force exerted on the resistance member 610 increases, the number of lights activated can increase. As another example, the color of a light can change as the amount of force exerted on the resistance member 610 increases. For instance, the light can be a first color (e.g., green) when the amount of force exerted on the resistance member 610 is within an acceptable range. The light can turn to a second color (e.g., yellow) when a threshold amount of exerted force is approached. The light can turn to a third color (e.g., red) when a threshold amount of exerted force is met or exceeded. In some arrangements, instead of a light changing the color of its output, there can be dedicated lights corresponding to different colors. For instance, a first light can be activated to emit the first color when the amount of force exerted on the resistance member 610 is within an acceptable range. A second light can be activated when a threshold amount of exerted force is approached (and the first light can be deactivated). A third light can be activated when a threshold amount of exerted force is met or exceeded) and the second light can be deactivated).

In one or more arrangements, the visual indicator can include one or more words, one or more phrases, one or more sentences, one or more symbols, one or more graphics, one or more images, one or more videos, and/or any combination thereof. In such case, the visual device(s) 762 can be one or more displays or a plurality of lights.

In one or more arrangements, the output interface(s) 760 can include one or more audial indicators. A "audial indicator" is any output that provides an alert, warning, or other auditory feedback reflecting a condition in a manner that is perceptible to the human sense of hearing. The audial indicator can be presented by one or more audial devices 764. The audial device(s) 764 can include one or more speakers, electroacoustic transducers, sound chips, and/or sound cards. In one or more arrangements, the audial device(s) 764 can be electric powered. It will be appreciated that the audial device(s) 764 are not limited to digital and electronic devices. Indeed, the audial device(s) 764 can be mechanical devices. As an example, the audial device(s) 764 can be configured to physically generate audial sounds (e.g., a 'click') when a certain amount of force exerted on the resistance member 610.

In some arrangements, the audial indicator can provide an indicator or warning based on the volume of the sound emitted from the audial device(s) 764. For instance, as the amount of force exerted on the resistance member 610 increases, the volume of the sound can increase. In some arrangements, the audial device(s) 764 can be implemented in parallel with the visual indicator. In some arrangements, the audial device(s) 764 can be activated when a threshold amount of exerted force is met or exceeded. For example, the audial device(s) 764 can be activated when a threshold corresponding to a maximum amount of exerted force is met or exceeded. In some arrangements, the audial device(s) 764 can be activated when a force exerted by a user is within an acceptable range. In some arrangements, the audial device(s) 764 can be activated when a force exerted by a user is within an acceptable range.

The audial indicator can have any suitable form. The audial indicator can include one or more sounds, one or more words, one or more phrases, one or more messages, or any combination thereof.

The system can include one or more retractor(s) 770. The retractor(s) 770 can be any suitable device, component, or system for retracting the resistance member 610 back toward the control unit 700 and/or to a non-extended position. The retractor(s) 770 can be any type of retractor, now know or later developed. In one or more arrangements, the retractor(s) 770 can be a seat belt retractor. The retractor(s) 770 can be configured to stop retraction of the resistance member 610 if it is being retracted too quickly.

The control unit 700 can include one or more resistance applicators 780. The resistance applicator(s) 780 can be any suitable device, component, or system configured to apply a resistance to the resistance member 610 or, more particularly, to the first segment 612 of the resistance member 610. As the resistance applied to the resistance member 610 varies, a user will vary the amount of force applied to the resistance member 610 (e.g., by pulling). The resistance applicator(s) 780 can be any type of device, now know or later developed. In one or more arrangements, the resistance applicator(s) 780 can be a seat belt tensioner. In one or more arrangements, the resistance applicator(s) 780 can be a motor, such as a brushless direct current motor.

The control unit 700 can include one or more modules, at least some of which will be described herein. The modules can be implemented as computer readable program code that, when executed by a processor, implement one or more of the various processes described herein. One or more of the modules can be a component of the controller(s) 710, or one or more of the modules can be executed on and/or distributed among other processing systems to which the controller(s) 710 is operatively connected. The modules can include instructions (e.g., program logic) executable by one or more processor(s). Alternatively or in addition, one or more data stores 720 may contain such instructions. In some arrangements, the one or more of the modules can be purely mechanical or physical (e.g., through a system of magnetic switches and relays).

The control unit 700 can include one or more modules. In one or more arrangements, the modules described herein can include artificial or computational intelligence elements, e.g., neural network, fuzzy logic or other machine learning algorithms. Further, in one or more arrangements, the modules can be distributed among a plurality of modules. In one or more arrangements, two or more of the modules described herein can be combined into a single module.

The control unit 700 can include one or more control modules 790. The control module(s) 790 can be configured to send control signals or commands over a communication network to one or more components of the control unit 700.

The control module(s) 790 can be configured to analyze data or information acquired by and/or received from the sensor(s) 730. Alternatively or additionally, the control module(s) 790 can be configured to detect inputs (e.g., commands) provided on the input interface(s) 750. The control module(s) 790 can retrieve raw data from the sensor(s) 730 and/or from the data store(s) 720. The control module(s) 790 can use profiles, parameters, thresholds, or settings loaded into the control module(s) 790 and/or stored in the data store(s) 720.

The control module(s) 790 can be configured to detect an amount of force a user has exerted on the resistance member 610. The control module(s) 790 can analyze sensor data received from the sensor(s) 730 to detect the amount of force a user has exerted on the resistance member 610. The control module(s) 790 can compare the detected amount of force to one or more thresholds, such as those input by a user, a provider, or other entity and/or stored in the data store(s) 720.

When a threshold level of resistance is detected, the control module(s) 790 can be configured to activate the output interface(s) 760, such as the visual device(s) 762 and/or the audial device(s) 764. For instance, the control module(s) 790 can be configured to cause a light to be activated when a threshold corresponding to a minimum level of force is met. The light can be a particular color (e.g., green) to indicate that the minimum level of force is met. As used herein, "cause" or "causing" means to make, force, compel, direct, command, instruct, and/or enable an event or action to occur or at least be in a state where such event or action may occur, either in a direct or indirect manner. Alternatively, the control module(s) 790 can be configured to cause a light to be activated when a threshold corresponding to a minimum level of force is not met. For instance, the light can be a particular color (e.g., red) to indicate that the minimum level of force has not been met.

The control module(s) 790 can be configured to activate a light when a threshold corresponding to a maximum level of force is met. The light can be a different color (e.g., red). Alternatively or additionally, the control module(s) 790 can be configured to activate the audial device(s) 764 when threshold corresponding to a maximum level of force is met.

In some arrangements, the control module(s) 790 can be configured to vary an amount of resistance offered by the resistance member 610. The control module(s) 790 can do so based on data or information stored in the data store(s) 720 and/or based on an input provided on the input interface(s) 750. The control module(s) 790 can send commands or signals to the resistance applicator(s) 780 to cause the resistance of the resistance member 610 to be adjusted.

The one or more elements of the system 600 described and shown herein can be provided as a kit. In one implementation, the kit can include the brace 100 only. In another implementation, the kit can include the control unit 700 only. In still another implementation, the kit can include only one or more resistance members 610. In still other implementations, the kits can include the brace 100, the control unit 700, one or more resistance members 610, or any combination or subset thereof.

The control unit 700 can include the generator(s) 740 for generating electrical energy to power the control unit 700. In some arrangements, the control unit 700 does not have a battery or other self-contained power source. However, in other arrangements, the control unit 700 may include a battery. In still other arrangements, the control unit 700 can be configured to be operatively connected to a power source, such as by being plugged into an electrical outlet.

The connecting member 640 can have a first end and a second end. The first end can be configured to be operatively connected to the brace 100, and the second end can be configured to be operatively connected to the control unit 700. In some arrangements, the first end of the connecting member 640 can be pre-attached to the control unit 700. In some arrangements, the connecting member 640 can be unattached from any other component in the kit.

In some arrangements, the kit can include the connecting member 640. The kit can include information and/or usage instructions.

Figure 8:
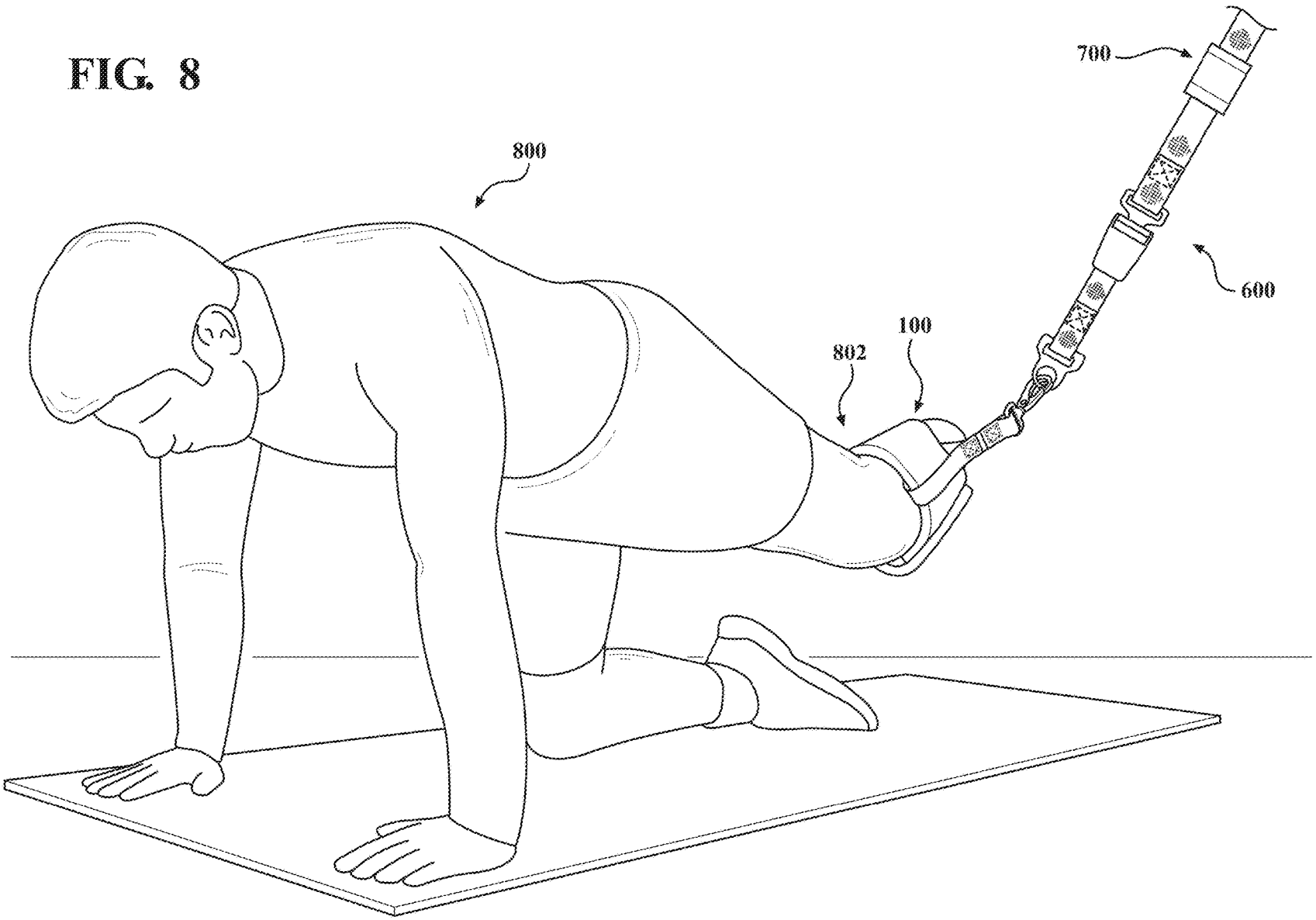
FIG. 8 is an example of the exercise system of FIG. 6 being used by a person with a limb difference.

A non-limiting example of the operation of the arrangements described herein will now be presented with respect to FIG. 8. The user 800 can have a lower limb difference. The user 800 can have a residual limb 802. The user 800 can be at home or in a gym or in almost any setting.

The user 800 can attach the connecting member 640 to the control unit and to a fixed structure. The user 800 can attach the brace 100 to the residual limb. In this case, the residual limb can be a lower limb. The user 800 can connect the brace 100 to the resistance member 610, which can be connected (or may already be connected) to the control unit 700.

The user can input one or more desired settings to the control unit 700. Alternatively, the settings may be pre-programmed in the control unit 700. Based on the settings, the control unit 700 can cause an appropriate amount of resistance to be applied to the resistance member 610. The control module(s) 790 can send signals or commands to the resistance applicator(s) 780 to do so.

The user can begin exercising. The motion of the residual limb will depend on the particular exercise being performed. The motion of the resistance member 610 can be converted into electrical energy by the generator(s) 740 to power one or more elements of the control unit 700. As the user exercises, the sensor(s) 730 can measure the force exerted on the resistance member 610 by the user. The control module(s) 790 and/or the controller(s) 710 can compare the exerted force to one or more threshold amounts. When a threshold amount is exceeded, the control module(s) 790 and/or the controller(s) 710 can cause an indicator (e.g., a visual indicator) to be presented to the user. When a maximum threshold is reached, the control module(s) 790 and/or the controller(s) 710 can cause one or more indicators to be presented to the user (e.g., a visual indicator and/or an audial indicator).

While arrangements have been shown and described herein in connection to a user with a lower limb difference, it will be appreciated that these arrangements are not limited to lower limb differences. Indeed, arrangements described herein are equally applicable to users with upper limb differences (e.g., a residual limb that terminates at the wrist, forearm, elbow, or upper arm).

It will be appreciated that arrangements described herein can provide numerous benefits, including one or more of the benefits mentioned herein. For example, arrangements described herein can make it easier for people with lower limb differences to engage in an active lifestyle and/or receive or better engage in physical therapy and rehabilitative exercises and activities. Arrangements described herein can enable a user with a limb difference to obtain an exercise system with a low upfront cost and/or with no ongoing costs. Arrangements described herein can enable a user to strengthen their residual limb to perform everyday activities. Arrangement described herein can help to ensure that the muscles in a residual limb do not atrophy. Arrangement described herein can help a user build strength to allow the user to get a prosthetic limb. Arrangements described herein can provide feedback during and/or outside of physical therapy sessions. Arrangements described herein can provide instantaneous feedback as a person is using the system. Arrangements described herein can support or replace existing resistance band exercises. Arrangements described herein can adapt to user anatomy and limit slippage of the brace. Arrangements described herein can avoid the use of a battery, as the device can be powered entirely by the usage of the device by a person. Arrangements described herein can enable a person to exercise in almost any location. Arrangements described herein are readily portable and can be stored in a compact manner.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "or" is intended to mean an inclusive "or" rather than an exclusive "or." The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g., AB, AC, BC or ABC). As used herein, the term "substantially" or "about" includes exactly the term it modifies and slight variations therefrom. Thus, the term "substantially parallel" means exactly parallel and slight variations therefrom. "Slight variations therefrom" can include within 15 degrees/percent/units or less, within 14 degrees/percent/units or less, within 13 degrees/percent/units or less, within 12 degrees/percent/units or less, within 11 degrees/percent/units or less, within 10 degrees/percent/units or less, within 9 degrees/percent/units or less, within 8 degrees/percent/units or less, within 7 degrees/percent/units or less, within 6 degrees/percent/units or less, within 5 degrees/percent/units or less, within 4 degrees/percent/units or less, within 3 degrees/percent/units or less, within 2 degrees/percent/units or less, or within 1 degree/percent/unit or less. In some instances, "substantially" can include being within normal manufacturing tolerances.

Aspects herein can be embodied in other forms without departing from the spirit or essential attributes thereof. Accordingly, reference should be made to the following claims, rather than to the foregoing specification, as indicating the scope hereof.

What is claimed is:

1. A system comprising: a brace including: a body sized to wrap around a portion of a human limb, the body having a proximal side and a distal side, the proximal side and the distal side being spaced from and opposite each other, the body having an undulating shape, where the proximal side and the distal side undulate in substantially the same direction; a first connector provided in a first end region of the body; and a second connector provided in a second end region of the body, when the first connector and the second connector are attached, the brace is held in a closed configuration in which the brace has a substantially conical shape; a control unit; and a resistance member having a first end operatively connected to the brace and a second end operatively connected to the control unit, the resistance member being a strap that does not stretch or exhibits minimal stretch, the control unit being configured to measure a force exerted on the resistance member by a user.

2. The system of claim 1, wherein the resistance member includes a first segment and a second segment.

3. The system of claim 2, wherein the first segment includes a receiver, and wherein the second segment includes a tongue, and wherein the tongue is configured to be operatively connected to the receiver, whereby the first segment and the second segment can be selectively coupled and decoupled from each other.

4. The system of claim 1, further including a third connector configured to attach the brace to the resistance member.

5. The system of claim 4, wherein the third connector includes a strap defining a loop through which a portion of the body is received.

6. The system of claim 1, wherein the control unit is configured to vary a resistance on the resistance member.

7. The system of claim 6, wherein the control unit includes an input interface that enables a user to set a resistance of the resistance member.

8. The system of claim 1, further including a light, and wherein the control unit is configured to:

determine when a force exerted on the resistance member exceeds a threshold; and cause the light to be activated.

9. The system of claim 1, further including a speaker, and wherein the control unit is configured to:

determine when a force exerted on the resistance member exceeds a threshold; and cause the speaker to emit an audial indicator.

10. The system of claim 1, wherein the control unit includes a generator for generating electrical energy to power the control unit, and wherein the control unit does not have a battery.

11. The system of claim 1, wherein the undulating shape is a multi-v shape or a multi-u shape.

12. The system of claim 1, further including a connecting member, wherein the connecting member is configured to be connected to the control unit and to a fixed structure.

13. The system of claim 1, further including a retractor operatively connected to the resistance member, and wherein the retractor is configured to retract the resistance member to a non-extended position.

14. A brace comprising:

a body sized to wrap around a portion of a human limb, the body having a proximal side and a distal side, the proximal side and the distal side being spaced from and opposite each other, the body having an undulating shape where the proximal side and the distal side undulate in substantially the same direction;

a first connector provided in a first lateral end region of the body; and a second connector provided in a second lateral end region of the body, the body having an open configuration and a closed configuration, when the first connector and the second connector are connected, the brace is held in the closed configuration where the brace has a substantially conical shape.

15. The brace of claim 14, wherein the undulating shape is a multi-v shape or a multi-u shape.

16. The brace of claim 14, further including a third connector configured to attach the brace to a resistance member.

17. The brace of claim 14, wherein, when the brace is in the closed configuration, a first opening in defined in the proximal side and a second opening is defined in the distal side, whereby the human limb is simultaneously receivable within the first opening and the second opening.

18. A kit comprising: a brace including a body sized to wrap around a portion of a human limb, the body having a proximal side and a distal side, the proximal side and the distal side being spaced from and opposite each other, the body having an undulating shape, where the proximal side and the distal side undulate in substantially the same direction, the brace including a first connector and a second connector provided in opposing lateral end regions of the body, when the first connector and the second connector are connected, the brace is held in a closed configuration in which the brace has a substantially conical shape; a resistance member being a strap that does not stretch or exhibits minimal stretch; and a control unit including a generator for generating electrical energy to power the control unit, the control unit not having a battery, the control unit being configured to cause a resistance to be applied to the resistance member, the resistance member having a first end configured for operative connection to the brace and a second end configured for operative connection to the control unit.

19. The kit of claim 18, further including a connecting member having a first end configured for operative connection to the control unit and a second end configured for operative connection to a fixed structure.

20. The kit of claim 18, wherein the second end of the resistance member is pre-attached to the control unit.

* * * * *